US006605766B2

(12) United States Patent
Teel

(10) Patent No.: US 6,605,766 B2
(45) Date of Patent: Aug. 12, 2003

(54) ACOUSTIC GUITAR ASSEMBLY

(75) Inventor: Timothy A. Teel, Lehighton, PA (US)

(73) Assignee: C. F. Martin & Company, Inc., Nazareth, PA (US)

( * ) Notice: Subject to any disclaimer, the term of this patent is extended or adjusted under 35 U.S.C. 154(b) by 0 days.

(21) Appl. No.: 09/862,273

(22) Filed: May 22, 2001

(65) Prior Publication Data

US 2002/0088330 A1 Jul. 11, 2002

Related U.S. Application Data

(60) Provisional application No. 60/260,737, filed on Jan. 10, 2001.

(51) Int. Cl.[7] ..... G10D 3/00
(52) U.S. Cl. ..... 84/291; 84/292; 84/267
(58) Field of Search ..... 84/291, 292, 267, 84/293, 290

(56) References Cited

U.S. PATENT DOCUMENTS

| | | | | | |
|---|---|---|---|---|---|
| 3,925,289 | A | * | 12/1975 | Sakato et al. | 524/101 |
| 4,188,850 | A | | 2/1980 | Kaman, II | 84/291 |
| 4,313,362 | A | | 2/1982 | Lieber | 84/267 |
| 4,840,102 | A | * | 6/1989 | Pittman | 84/293 |
| 5,033,349 | A | * | 7/1991 | Nechville | 84/272 |
| 5,333,527 | A | * | 8/1994 | Janes et al. | 84/291 |
| 5,406,874 | A | | 4/1995 | Witchel | 84/291 |
| 5,461,958 | A | | 10/1995 | Dresdner et al. | 84/267 |
| 5,952,592 | A | | 9/1999 | Teel | 84/291 |
| 6,034,309 | A | | 3/2000 | Teel et al. | 84/291 |
| 6,233,825 | B1 | * | 5/2001 | DeGroot | 29/896.22 |

* cited by examiner

*Primary Examiner*—Shih-Yung Hsieh
(74) *Attorney, Agent, or Firm*—Howson and Howson

(57) ABSTRACT

An acoustic guitar having a soundboard and a head-plate made of a sheet of metal, such as a sheet of aluminum. The outward facing surfaces of the soundboard and head-plate are provided with a decorative appearance such as by etching or sanding a pattern thereon. The metal soundboard and head-plate provide the acoustic guitar with a unique appearance and enhance durability without adversely affecting the tonal qualities of the guitar.

16 Claims, 4 Drawing Sheets

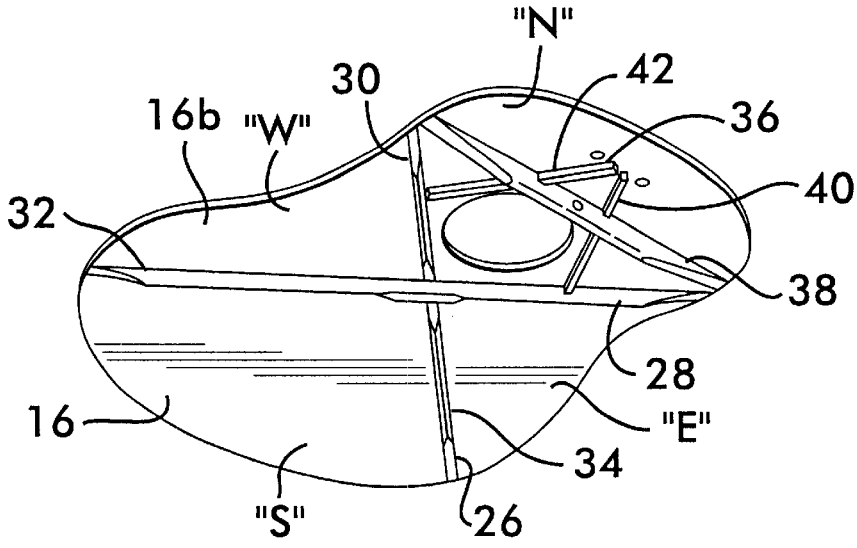
FIG.2
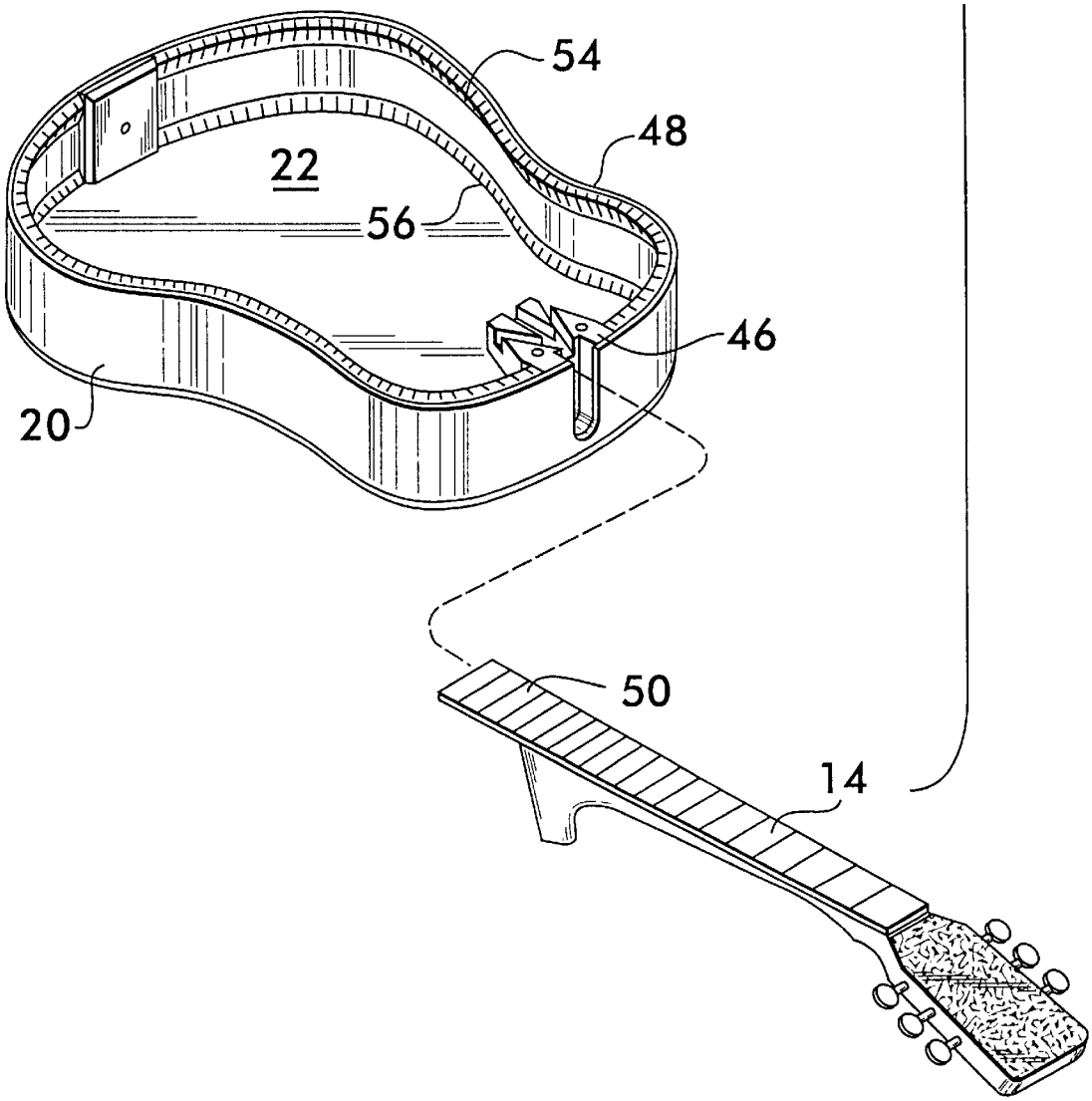

ACOUSTIC GUITAR ASSEMBLY

This application claims the benefit of Provisional Application No. 60/260,737, filed Jan. 10, 2001.

FIELD OF THE INVENTION

The present invention relates to stringed instruments, such as, acoustic guitars, and more particularly, the present invention relates to a novel acoustic guitar assembly which includes a soundboard and/or head-plate made of decorative non-wooden material.

BACKGROUND OF THE INVENTION

A typical acoustic guitar has a hollow body connected to a neck. The hollow body has a soundboard with a soundhole, a backboard spaced from the soundboard, and a shaped sidewall which extends between the soundboard and backboard. Typically, these components are constructed of choice pieces of wood.

Prior art designs have attempted to improve upon the strength and durability of acoustic guitars without adversely affecting the playing qualities of the guitar. For example, U.S. Pat. No. 5,461,958 which issued to Dresdner et al. and which is assigned to the assignee of the present application discloses an acoustic guitar assembly having a wooden soundboard with an improved soundboard bracing structure and an improved neck to body joint.

Acoustic guitar bodies have also been manufactured from non-wooden high pressure laminate materials. For example, U.S. Pat. No. 5,406,874 which issued to Witchel and which is assigned to the assignee of the present application discloses an acoustic guitar constructed from relatively inexpensive, non-wooden materials. The hollow body of the guitar, including the sidewall, soundboard and baseboard, is constructed of sheets of synthetic resin laminates, such as, melamine impregnated resins impressed over phenolic kraft layers.

U.S. Pat. No. 5,952,592 which issued to Teel and which is assigned to the assignee of the present application provides another example of a guitar body made of high pressure laminate materials. U.S. Pat. No. 6,034,309 discloses a method of manufacturing a guitar body made of high pressure laminate materials. Such guitars made of non-wooden laminates provide an economic alternative for the purchaser of a high quality acoustic guitar, and due to dwindling wood resources, provide an ecologically-friendly alternative to traditional solid and laminated tonewoods.

Although the above-mentioned acoustic guitar assemblies accomplish their intended purposes, there is a need for a high quality, durable acoustic guitar which is at least partly constructed from alternate non-wooden materials which provide both a novel decorative appearance and superior acoustic performance. In particular, the soundboard of the acoustic guitar should be made of a non-wooden material which provides a unique decorative appearance and which is capable of structurally withstanding the forces created by tensioned guitar strings. In addition, other components of the acoustic guitar, such as the head plate, can also be constructed of similar decorative non-wooden material.

OBJECTS OF THE INVENTION

With the foregoing in mind, a primary object of the present invention is to provide a high quality acoustic guitar which can be manufactured economically relative to traditional all wooden acoustic guitar models.

Another object of the present invention is to provide an acoustic guitar with at least a soundboard and head-plate constructed of a non-wooden material which provides a unique decorative appearance and which does not adversely affect the tonal qualities of the guitar.

SUMMARY OF THE INVENTION

More specifically, the present invention provides a stringed musical instrument having a hollow body and an elongate neck extending from said hollow body to a headstock. The hollow body is formed of a soundboard with a soundhole, a backboard spaced from the soundboard, and a sidewall extending between and connecting the soundboard and backboard. The soundboard is made of a solid sheet of metal, and preferably, the headstock has a head plate which is also made of a sheet of metal. In addition, preferably the outward facing surfaces of the metal soundboard and head-plate are decorated, for instance, by having a pattern etched or sanded into the metal surfaces.

BRIEF DESCRIPTION OF THE DRAWINGS

The foregoing and other objects, features and advantages of the present invention should become apparent from the following description when taken in conjunction with the accompanying drawings, in which:

FIG. 2 is an exploded view of the acoustic guitar illustrated in FIG. 1;

DETAILED DESCRIPTION OF THE PREFERRED EMBODIMENT

Figure 1:
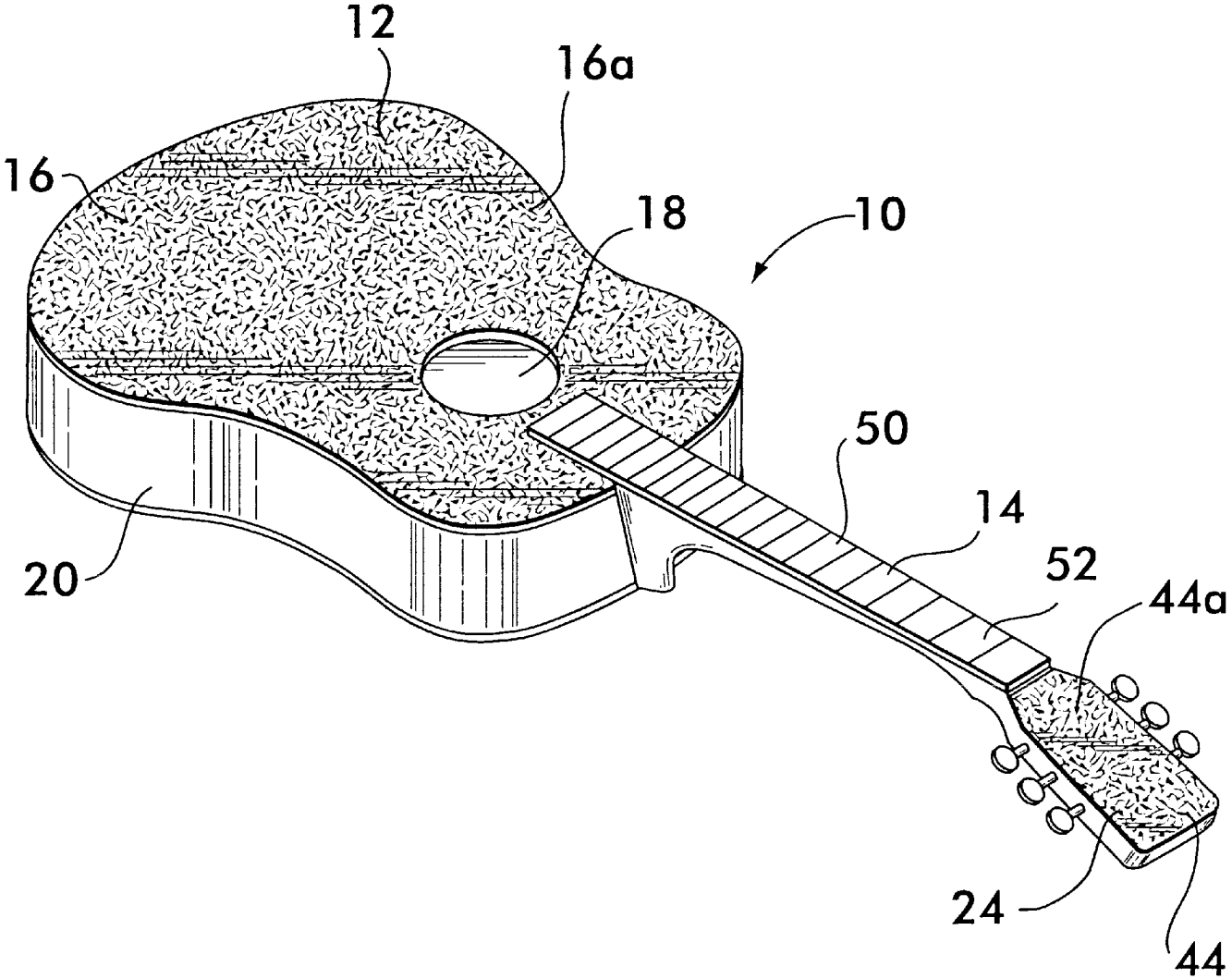
FIG. 1 is a perspective view of an acoustic guitar according to the present invention.

Referring now to the drawings, FIG. 1 illustrates an acoustic guitar 10 having a hollow body 12 and a neck 14. The body has a soundboard 16 with a circular soundhole 18. The soundboard 16 is connected to sidewall 20 which, in turn, is connected to a backboard 22. The neck 14 has a headstock 24, and strings (not shown) are strung from the headstock 24 in a direction along the neck 14, across the soundhole 18 and to a bridge (not shown) on the outer side 16*a* of the soundboard 16.

One of the novel aspects of the present invention is that at least the soundboard 16 of the hollow body 12 is made of a sheet of metal. For instance, the soundboard 16 could be made of a sheet of aluminum, brass, copper, stainless steel, or other metal which is cut into a desired shape. The sheet of metal can be provided in any desired thickness, examples include a thickness of about 0.032 inch or about 0.040 inch.

Preferably, the outward facing surface 16*a* of the soundboard 16 is provided with a decorative appearance. See FIGS. 1 and 3 as examples. The decorative appearance can be provided by etching or sanding a pattern onto the surface 16*a* of the soundboard 16. Alternatively, the metal surface 16*a* can be subjected to color anodizing, painting, or chrome and gold plating to provide a decorative appearance.

Preferably, the underside 16*b* of the metal soundboard 16 is provided with bracing, 26 and 36, to provide the acoustic guitar 10 with durability and acoustic quality. Bracing is required since tension created by the strings of the guitar can cause damage to the soundboard 16, particularly in a region adjacent the soundhole 18. In addition, if the soundboard 16 is permitted to "lift up" or "belly", then the height of the strings above the neck increases making the guitar difficult to play. Thus, in order to reinforce the soundboard 16, bracing is secured to the underside 16*b* of the soundboard. In addition, although the bracing must prevent "bellying", it should not over-stiffen the soundboard 16 and deaden the acoustics of the guitar 10.

The bracing pattern of the present invention can utilize, for example, an X-brace 26 and an A-brace 36. The bracing can be made from a wood or non-wooden material which has a predetermined density and thickness and is glued to the underside 16*b* of the soundboard 16.

The X-brace 26 and the A-brace 36 are provided to completely encompass the soundhole 18 and support the area of the soundboard 16 adjacent the soundhole 18. This support prevents extreme bending of the soundboard 16 between the soundhole 18 and the outer peripheral edge of the guitar 10. As best illustrated in FIG. 2, the X-brace 26 extends across a substantial portion of the underside 16*b* of the soundboard 16 and has four upstanding legs, 28, 30, 32, and 34. The legs 28 and 30 of the X-brace 26 define a first, or northernmost, quadrant "N", and the legs 32 and 34 define an opposite, or southernmost, quadrant "S". Side quadrants, "E" and "W", are defined by legs 28 and 34 and legs 30 and 32, respectively. The soundhole 18 is located within the northern quadrant "N" and is structurally supported by legs 28 and 30 of the X-brace 26. The area of the soundboard 16 furthest from the neck 14 is supported by legs 32 and 34 of the X-brace.

The A-brace 36 extends in the northern quadrant "N" across the portion of the soundboard 16 between the legs 28 and 30 of the X-brace 26 and the neck 14. The A-brace 36 has three legs 38, 40 and 42 which structurally support the area of the soundboard adjacent the soundhole 18 and neck 14. The leg 38 extends transversely of the soundboard 16 and neck 14 between the soundhole 18 and neck 14. The transverse leg 38 is notched to secure the legs 40 and 42 to the underside of the soundboard. The A-brace 36 also provides structural support for the neck to body joint.

Although a particular bracing pattern is illustrated and discussed, other bracing patterns can also be utilized in accordance with the present invention.

Figure 3:
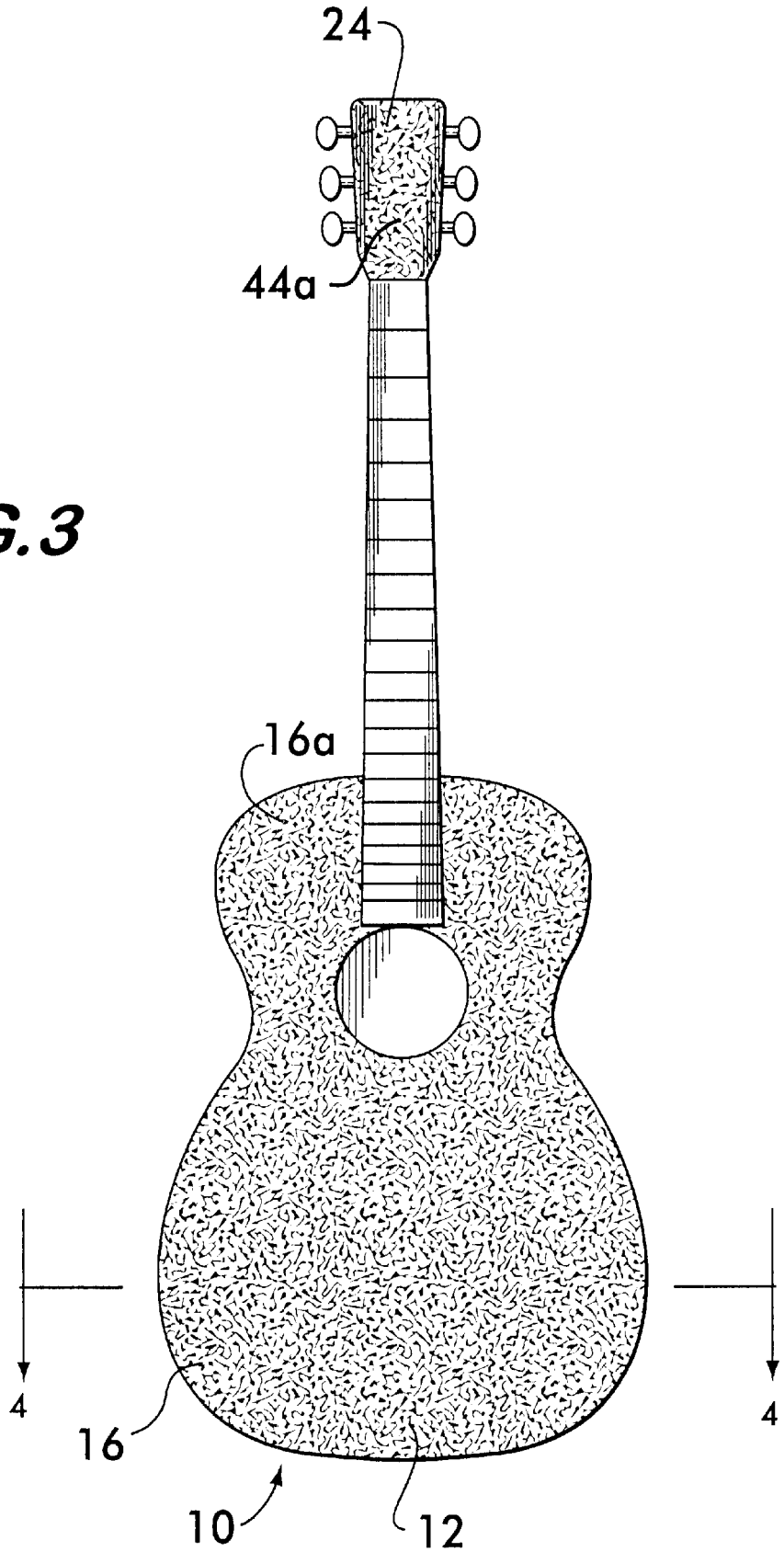
FIG. 3 is a front elevational view of the acoustic guitar illustrated in FIG. 1.
Figure 4:
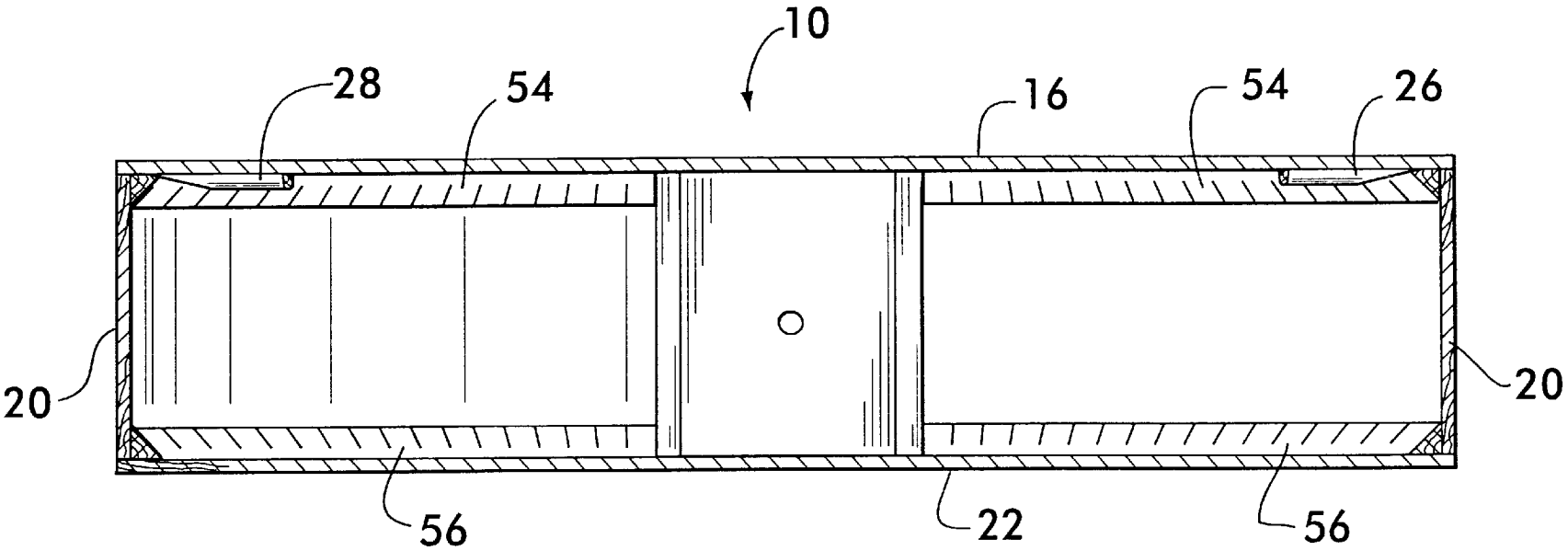
FIG. 4 is a cross-sectional view of the acoustic guitar taken along line 4—4 of FIG. 3.

According to another aspect of the present invention, the headstock 24 of the acoustic guitar 10 has a head-plate 44 made of a sheet of metal. Thus, as shown in FIG. 3, the forward facing surface of the head-plate 44 can be provided with a decorative appearance in addition to the outer surface 16*a* of the soundboard 16 so that the acoustic guitar 10 is provided with an overall unique appearance. Similar to the soundboard 16, the head-plate 44 can be made of a sheet of aluminum, brass, copper, stainless steel, or other metal which is cut into a desired shape, and a decorative appearance can be provided by etching, sanding, color anodizing, painting, or chrome and gold plating a pattern onto the metal surface 44*a* of the head-plate 44.

The remaining parts of the hollow body, such as the backboard 22 and sidewall 20 can be made of similar metal materials. However, a preferred embodiment utilizes a backboard and sidewall made of non-metallic high pressure laminate materials such as those disclosed in U.S. Pat. No. 5,406,874 issued to Witchel, U.S. Pat. No. 5,952,592 issued to Teel and U.S. Pat. No. 6,034,309 issued to Teel et al. Solid wooden materials can also be utilized.

The hollow body 12 is assembled by gluing the soundboard 16 and backboard 22 to the sidewall 20 with an adhesive. Preferably, a methyl methacrylate adhesive is utilized to adhesively secure any metal surface to any other surface. For instance, the methyl methacrylate adhesive is utilized to secure the metal soundboard 16 to the sidewall 20 and the metal head-plate 44 to the headstock 24. Other well known and less expensive adhesives can be utilized to secure non-metal surfaces to other non-metal surfaces. Preferably, as illustrated in FIG. 2, the hollow body includes a frontblock 46 to which the neck 14 is connected, and ribbon lining 54 and 56 adhesively secured to the sidewall 20 adjacent the longitudinal edges 48 of the sidewall 20.

The neck 14 of the present invention can be constructed of a solid piece of wood, such as mahogany, or can be made of a strong plywood material which is glued with and at least partially impregnated with a phenolic resin. The neck includes an elongate section 50 and terminates in the headstock 24. A fingerboard 52 is attached to the front face of the elongate section 50 of the neck 12 and a metal head plate 44, as discussed above, is adhesively secured to the headstock 24.

The above described structural features facilitate ready manufacture and provide a durable and uniquely decorated acoustic guitar.

While a preferred embodiment of an acoustic guitar has been described, various modifications, alterations, and changes may be made without departing from the spirit and scope of the present invention as defined in the appended claims.

What is claimed is:

1. A musical instrument, comprising:

an acoustic guitar having a hollow body and an elongate neck extending from said hollow body and having a headstock;

said hollow body having a soundboard with a soundhole, a backboard spaced from said soundboard, and a sidewall extending between and secured to said soundboard and backboard;

said soundboard being made of a solid piece of sheet metal and having a planar underside and a planar outward facing side, said planar underside having wooden bracing adhesively secured thereto; and said backboard and sidewall of said hollow body being made of non-metallic high pressure laminate material.

2. A musical instrument according to claim 1, wherein said metal is selected from the group consisting of aluminum, brass, copper and stainless steel.

3. A musical instrument according to claim 1, wherein said outward facing side of said soundboard has a decorated surface.

4. A musical instrument according to claim 3, wherein said decorated surface is selected from the group consisting of a pattern sanded into said surface, a pattern etched into said surface, a color anodized surface, a painted surface, a chrome plated surface, and a gold plated surface.

5. A musical instrument according to claim 1, wherein said soundboard has a thickness of about 0.032 inch to about 0.040 inch.

6. A musical instrument according to claim 1, wherein said soundboard is secured to said sidewall with an adhesive.

7. A musical instrument according to claim 6, wherein said adhesive is methyl methacrylate.

8. A musical instrument according to claim 1, wherein said bracing includes an X-brace having four legs defining four quadrants on said soundboard, a pair of said X-brace legs define a first quadrant in which said soundhole is located, and the other pair of said X-brace legs define an opposite quadrant on the soundboard remote from said neck of the musical instrument.

9. A musical instrument according to claim 8, wherein said bracing includes an A-brace located in said first quadrant on said soundboard between said soundhole and said neck, said A-brace cooperating with said X-brace to completely surround said soundhole.

10. A musical instrument according to claim 1, wherein said headstock has a front face with a head plate which is made of a sheet of metal.

11. An acoustic guitar, comprising:

a hollow body; and an elongate neck extending from said hollow body and having a headstock;

said hollow body having a soundboard with a soundhole, a backboard spaced from the soundboard, and a sidewall extending between and connecting the soundboard and backboard;

said soundboard being made of a solid planar sheet of metal and having a planar underside with wooden bracing adhesively secured thereto; and said headstock having a front surface substantially facing in a same direction as said soundboard, said front surface being formed by a head plate made of a sheet of metal.

12. An acoustic guitar according to claim 11, wherein said metal of said soundboard and said headstock is selected from the group consisting of aluminum, brass, copper and stainless steel.

13. An acoustic guitar according to claim 12, wherein each of said soundboard and said headstock have an outwardly facing decorated surface, and wherein each of said decorated surfaces is selected from the group consisting of a pattern sanded into said surface, a pattern etched into said surface, a color anodized surface, a painted surface, a chrome plated surface, and a gold plated surface.

14. An acoustic guitar according to claim 11, wherein said backboard and sidewall of said hollow body are made of a non-metal material.

15. An acoustic guitar according to claim 11, wherein at least one of said backboard and sidewall of said hollow body are made of metal.

16. An acoustic guitar, comprising:

a hollow body; and an elongate neck extending from said hollow body and having a headstock;

said hollow body having a soundboard with a circular soundhole, a backboard spaced from said soundboard, and a sidewall extending between and adhesively secured to said soundboard and backboard;

said soundboard being made of a solid planar sheet of aluminum and having a planar underside with wooden bracing adhesively secured thereto;

said headstock having a front surface substantially facing in a same direction as said soundboard, said front surface being formed by a head plate made of a sheet of aluminum; and said backboard and sidewall of said hollow body being made of non-metallic high pressure laminate material.

* * * * *